United States Patent [19]

Ikeura et al.

[11] 4,438,748

[45] Mar. 27, 1984

[54] METHOD OF SUPPLYING FUEL TO AN INTERNAL COMBUSTION ENGINE DURING START-UP

[75] Inventors: Kenji Ikeura; Hiroshi Yamaguchi; Kunifumi Sawamoto; Tatsuo Morita, all of Yokosuka, Japan

[73] Assignee: Nissan Motor Co., Ltd., Yokohama, Japan

[21] Appl. No.: 353,825

[22] Filed: Mar. 2, 1982

[30] Foreign Application Priority Data

Mar. 4, 1981 [JP] Japan ..... 56-29797

[51] Int. Cl.[3] ..... F02N 17/00

[52] U.S. Cl. ..... 123/491; 123/179 L

[58] Field of Search ..... 123/491, 179 L, 179 G

[56] References Cited

U.S. PATENT DOCUMENTS

| | | | |
|---|---|---|---|
| 3,982,519 | 9/1976 | Moon | 123/179 L |
| 4,027,641 | 6/1977 | Moder | 123/491 |
| 4,283,762 | 8/1981 | Graessley | 123/491 |
| 4,349,000 | 9/1982 | Staerzl | 123/491 |

*Primary Examiner*—Ronald B. Cox

*Attorney, Agent, or Firm*—Schwartz, Jeffery, Schwaab, Mack, Blumenthal & Koch

[57] ABSTRACT

In a method of supplying fuel to an internal combustion engine during start-up, the occurence of combustion is detected to arrest the change of the fuel supply quantity until steady-state engine operation is achieved. Combustion is detected by comparing sensed engine speed to a minimum engine speed resulting from combustion in the cylinders. Additionally, control values used to derive the start-up fuel quantity are modified so that the fuel quantity increases monotonically from a relatively low initial value until fuel ignition is detected.

8 Claims, 22 Drawing Figures

METHOD OF SUPPLYING FUEL TO AN INTERNAL COMBUSTION ENGINE DURING START-UP

BACKGROUND OF THE INVENTION

The invention relates to a method of controlling the supply of fuel to an internal combustion engine during engine start-up and is especially applicable to cold-weather starting.

Fuel supply control systems for vehicular engines commonly employ different control methods for fuel supply during engine start-up and during normal operation. In such prior art fuel supply methods, the fuel injection or carburetion quantity starts rather high at the beginning of engine cranking and gradually decreases at a predetermined rate to a fuel supply quantity corresponding to idling. The high initial fuel quantity ensures an adequately rich air/fuel mixture for ignition, but the predetermined rate of decrease may be too fast to maintain adequate fuel concentration throughout the starting process, especially in very cold weather. That is, even if combustion occurs and the engine catches briefly, the fuel supply quantity may drop so quickly that the engine dies again. Furthermore, if the engine should achieve some combustion and then stop due to insufficient fuel, the resultant flooding of the spark plugs will delay the next attempt to start the engine.

SUMMARY OF THE INVENTION

With these problems in mind, the method of the invention serves to change fuel supply to the engine during cranking until fuel ignition occurs and then hold the fuel supply at a near-constant level until steady-state engine operation is achieved. Additionally, the fuel supply quantity is increased from a relatively low value until combustion in order to prevent flooding of the spark plugs.

In the preferred embodiment of the invention, the fuel supply quantity starts at a level not quite sufficient for combustion, increases with time until combustion occurs, and thereafter is held at a level which changes only with respect to engine speed. In this embodiment, combustion is detected by comparing instantaneous engine speed to a reference speed corresponding to the minimum engine speed generated in response to combustion.

BRIEF DESCRIPTION OF THE DRAWINGS

The features and advantages of the present invention can be more easily understood from the following description of a preferred embodiment thereof, taken in conjunction with the attached drawings, in which like reference numerals designate corresponding elements.

DETAILED DESCRIPTION OF THE PREFERRED EMBODIMENTS

Figure 1:
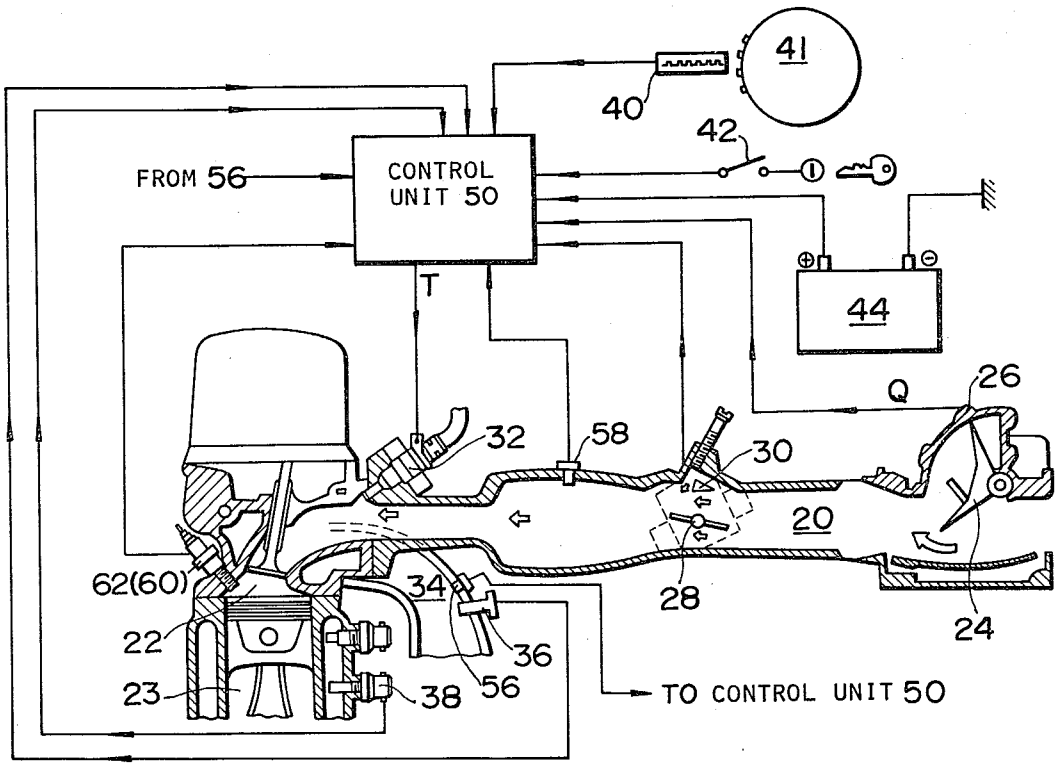
FIG. 1 is a diagram of relationships among an internal combustion engine, associated sensor and control signals, and a fuel supply control unit suitable for execution of the method of the present invention.

To facilitate understanding of the present invention, a prior art method of supplying fuel to a fuel-injected internal combustion engine during start-up will be described with reference to FIGS. 1 through 9. Pertinent portions of an engine are shown in FIG. 1. Air from outside is drawn through an intake duct 20 in the direction of the arrows to the combustion chamber 22 of each cylinder 23 of the engine. The intake air causes an air flow vane 24 to rotate, and an air flow meter 26 responds to the position of vane 24 to output an intake air flow signal Q. The intake air flow is controlled by a throttle valve 28 disposed between vane 24 and cylinder 23. During idling, throttle valve 28 is closed and an idle switch 30 is turned on.

A fuel injection valve 32 is adapted to open to inject fuel into the intake air stream between throttle valve 28 and cylinder 23. The resultant air/fuel mixture is burned in the combustion chamber 22 and exhausted through an exhaust duct 34. An exhaust gas oxygen sensor 36 is provided within exhaust duct 34 to monitor and output a signal indicative of the $O_2$-gas concentration in the exhaust gas.

Reference numeral 38 denotes a temperature sensor in the water jacket surrounding cylinder 23, which outputs a signal indicative of engine temperature. Numeral 40 denotes a crank angle sensor known which detects the rotation of the engine crankshaft 41 to output a signal comprising a train of pulses, each representing a small, constant angle of rotation, such as 1°. Numeral 42 denotes a starter motor switch which is closed when the engine is to be started. Numeral 44 denotes an automotive battery which serves to supply DC voltage to electrically-actuated elements of the vehicle.

Numeral 50 denotes a fuel supply control unit which receives all of the aforementioned signals and the battery voltage. Control unit 50 processes the various signals according to procedures to be described later and outputs a fuel supply signal T to fuel injection valve 32. Fuel supply signal T is adapted to order the opening of valve 32 for a period of time necessary to inject the amount of fuel appropriate to demand as indicated by the received sensor signals.

Figure 2:
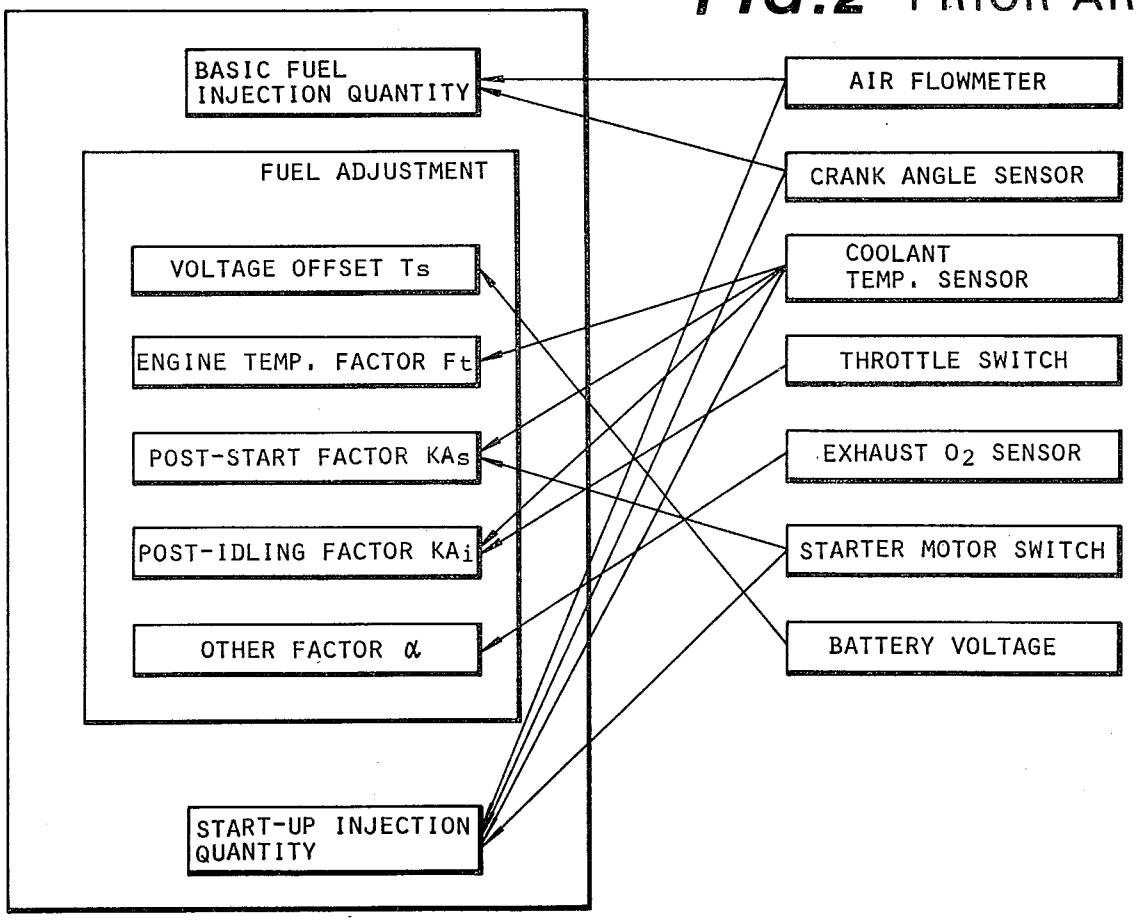
FIG. 2 PRIOR ART
FIG. 2 is a diagram of the relationships between sensed engine condition signals and various values used in the calculation of fuel supply quantity by the control unit of FIG. 1.
Figure 3:
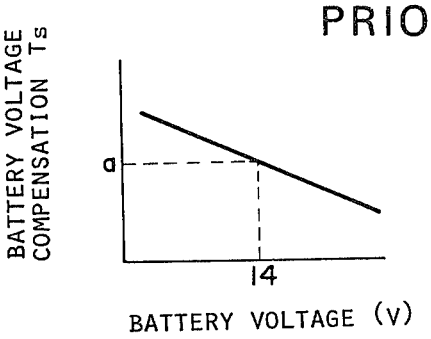
FIG.3 PRIOR ART
FIG. 3 is a graph of the relationship between battery voltage compensation $T_s$ and battery voltage.
Figure 4:
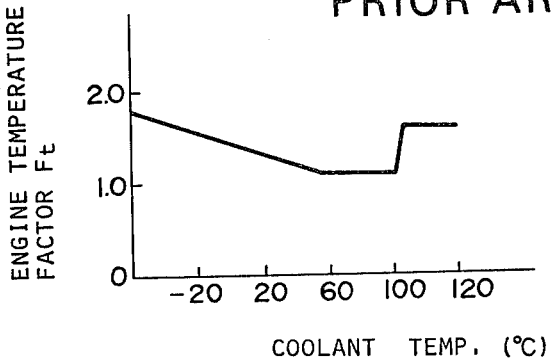
FIG.4 PRIOR ART
FIG. 4 is a graph of the relationship between engine temperature factor $F_t$ and coolant temperature.
Figure 5:
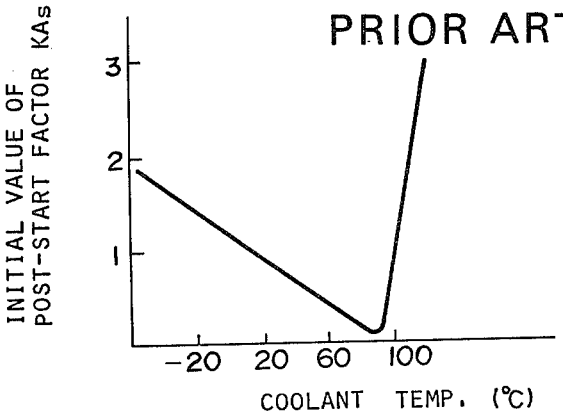
FIG.5 PRIOR ART
FIG. 5 is a graph of the relationship between the initial value of the post-start factor $KA_s$ and coolant temperature.
Figure 6:
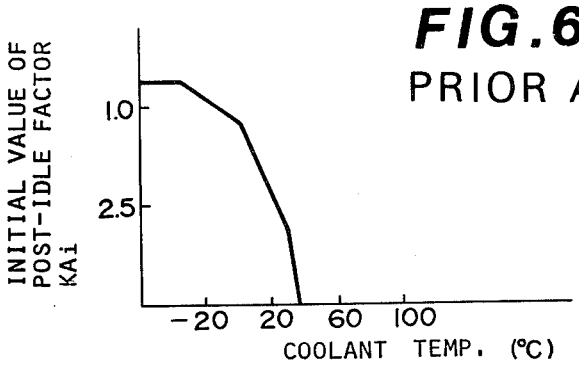
FIG.6 PRIOR ART
FIG. 6 is a graph of the relationship between the initial value of the post-idle factor $KA_i$ and coolant temperature.

Control unit 50 uses the received signals to generate a basic fuel injection quantity, a plurality of fuel adjustment values, and a start-up injection quantity, as shown diagrammatically in FIG. 2. The various fuel adjustments can be briefly described as follows:

(1) battery voltage compensation $T_s=a+b(14-V_B)$, where a, b are constant and $V_B$ is the received battery voltage, as shown in FIG. 3;

(2) engine temperature factor $F_t$ to enrich the mixture ratio for a cold engine, derived from the graph of FIG. 4 in accordance with the signal from the coolant temperature sensor 38;

(3) post-start factor $KA_s$, the initial value of which is derived from the graph of FIG. 5, and which decreases to zero with elapsed time in order to obtain smooth engine start and smooth transition from start to idling;

(4) post-idling factor $KA_i$, the initial value of which is derived from the graph of FIG. 6 immediately after the idle switch 30 is opened and which decreases with time in order to obtain smooth beginning of vehicle movement; and (5) another adjustment factor $\alpha$, which includes exhaust factor derived from the signal from sensor 36.

Figure 7:
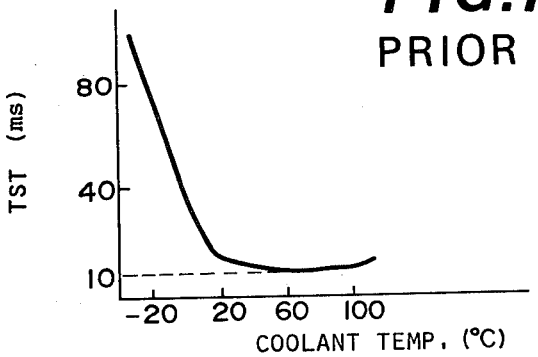
FIG.7 PRIOR ART
FIG. 7 is a graph of the relationship between TST and coolant temperature as employed in the prior art.
Figure 8:
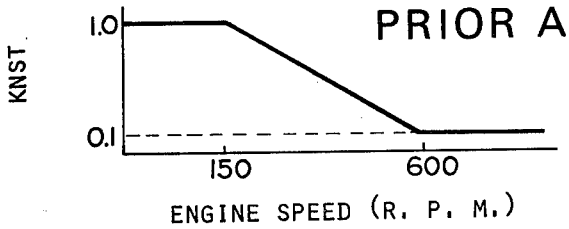
FIG.8 PRIOR ART
FIG. 8 is a graph of the relationship between KNST and coolant temperature.
Figure 9:
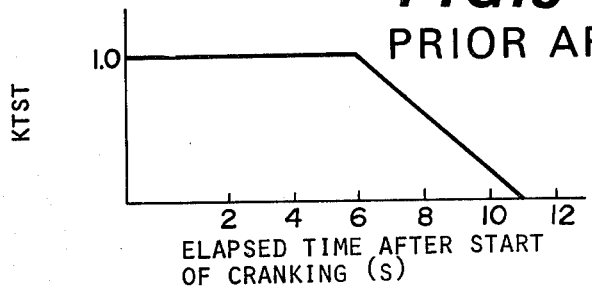
FIG.9 PRIOR ART
FIG. 9 is a graph of the relationship between KTST and time as employed in the prior art.

The received sensor signals are also used to derive values employed in the calculation of the start-up injection quantity. In particular, three values TST, KNST, and KTST are multiplied to obtain an initial fuel supply value $T_2$. TST is a timing value which changes in accordance with engine temperature, as shown in FIG. 7. KNST and KTST are multiplicative factors which decrease with increasing engine speed and time respectively, as shown in FIGS. 8 and 9. In summation, $$T_2=TST\times KNST\times KTST. \quad (1)$$

A second fuel supply value $T_1$ is also calculated as part of start-up injection quantity calculation based on the basic fuel injection quantity $T_p$. $T_p$ is derived from air flow Q and engine speed N information as follows: $T_p=(Q/N)\times K$, where K is a constant. $T_1$ is given by the following equation:

$$T_1=T_p\times(F_t+KA_s)\times 1.3+T_s. \quad (2)$$

The larger of values $T_1$ and $T_2$ is outputted to fuel injection valve 32 during engine start-up.

A third fuel supply value $T_o$ is used after the engine has achieved steady-state operation. This value is given by the following equation:

$$T_o=T_p\times(F_t+KA_s+KA_i)\times\alpha+T_s. \quad (3)$$

As can be understood from the graph of FIG. 9, the value of KTST is maintained at a constant value of 1.0 until 6 seconds after the starter motor is first turned on, decreases at a predetermined rate independent of any engine conditions and drops to zero after about 11 seconds after the starter motor is first turned on. In turn, the value of $T_2$ starts to decrease relentlessly after about 6 seconds of cranking.

With this prior art fuel supply method, the fuel injection or carburetion quantity starts rather high at the beginning of engine cranking and gradually decreases at a predetermined rate to a fuel supply quantity corresponding to idling. The high initial fuel quantity ensures an adequately rich air/fuel mixture for ignition, but the predetermined rate of decrease may be too fast to maintain adequate fuel concentration throughout the starting process, especially in very cold weather. That is, even if combustion occurs and the engine catches briefly, the fuel supply quantity may drop so quickly that the engine dies again. Furthermore, if the engine should achieve some combustion and then stop due to insufficient fuel, the resultant flooding of the spark plugs will delay the next attempt to start the engine.

The method of the present invention is directed toward a solution to this problem. In particular, the inventive method of supplying fuel during cranking includes the steps of detect first combustion, and thereafter holding the fuel supply substantially constant for a period of time sufficient for the engine to achieve complete combustion. Additionally, the first fuel supply value $T_2$ can be adapted to increase from a relatively low value until combustion occurs in order to prevent flooding due to an excessively rich initial air/fuel mixture.

Figure 10:
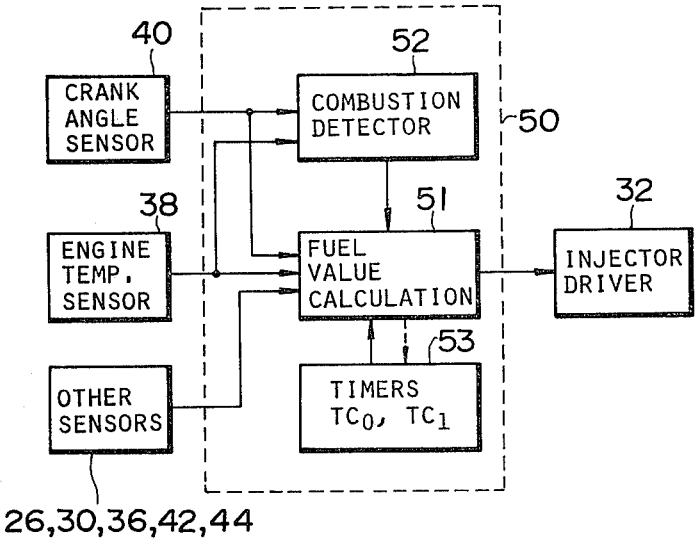
FIG. 10 is a diagram to aid understanding of some functions of the method of the present invention as embodied by the control unit of FIG. 1.

FIG. 10 clarifies the operation of the control unit 50 while performing a preferred embodiment of the method of the present invention. Functional block 51 denotes the functions of control unit 50 previously described with reference to FIGS. 2 through 9. Functional block 52 denotes a combustion detector which serves to recognize the occurrence of first combustion and output a signal indicative thereof. In this embodiment, combustion detector 52 responds to signals from crank angle sensor 40 and engine temperature sensor 38 to detect fuel ignition by a method to be explained later. Functional block 53 denotes a pair of timers used in the preferred embodiment of the invention in a manner to be described later. As in the prior art method, a fuel supply value calculated in block 51 is outputted to actuate a driver 33 for fuel injection valve 32. In response to the signal from cmbustion detector 52, block 51 holds the fuel supply value at a level independent of time until engine start procedure is completed or the end of predetermined period, as described in greater detail below.

Figure 11:
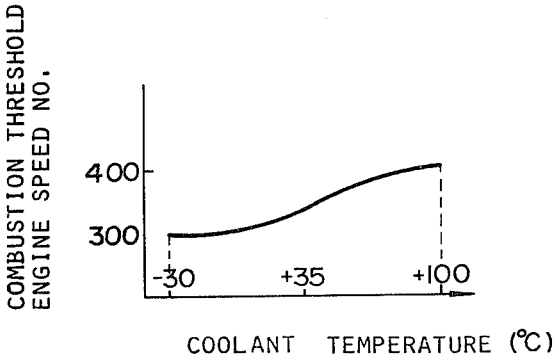
FIG. 11 is a graph of threshold engine speed $N_o$ versus coolant temperature according to the present invention.

Combustion detector 52 employs the relationship graphed in FIG. 11. The abscissa of FIG. 11 covers the normal range of initial engine temperatures as sensed by temperature sensor 38. The ordinate yields the value of the threshold engine speed $N_o$, which is slightly greater than the cranking engine speed at the corresponding engine temperature. Thus, engine speeds greater than $N_o$ at the current engine temperature indicate that the air/fuel mixture is being ignited, i.e. the engine has started. Combustion detector 52 uses the signal from temperature sensor 38 to find the current value of $N_o$, uses the signal from crankshaft rotation sensor 40 to determine the current engine speed, and compares the two values to output a signal indicative of mixture combustion if engine speed is greater than $N_o$.

Figure 12:
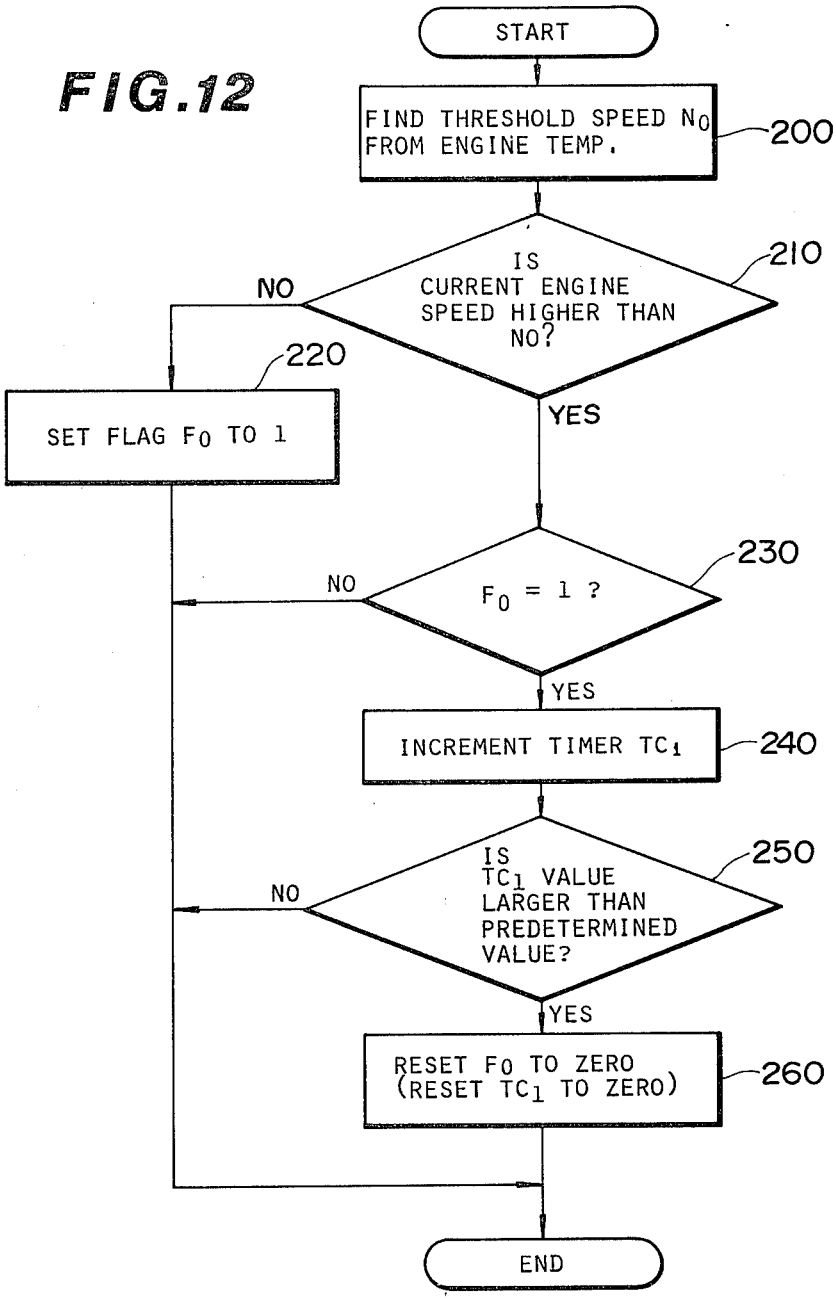
FIG. 12 is a flowchart of the combustion detection routine for use in the method of FIG. 13.

This function is shown in more detail in FIG. 12. After receiving engine speed and temperature information from sensors 40 and 38 respectively, the combustion threshold engine speed $N_o$ is derived from the graph of FIG. 11 (step 200). In step 210, current engine speed is compared to the derived value of $N_o$ - if engine speed is greater than $N_o$, control goes to step 230, otherwise control passes to step 220. At step 220, a flag $F_o$ is set to "1" to indicate that combustion has not been achieved and control goes to the end of the combustion detection routine. At step 230, the previous state of flag $F_o$ is checked - if $F_o$="1", control goes to step 240, otherwise the routine ends. At step 240, a timer $TC_1$ is incremented. At step 250, the value of timer $TC_1$ is compared to a predetermined value - if $TC_1$ is greater, control goes to step 260, otherwise the routine ends. At the final step 260, flag $F_o$ is set to zero to indicate the occurence of fuel combustion at this mixture ratio, and $TC_1$ is reset to zero for its next use.

This routine is repeated by constant interval (for example each 10 ms) during cranking.

The predetermined value of step 250 is chosen to provide a slight averaging effect to the engine speed measurement in conjunction with timer $TC_1$. That is, on the time scale of execution of the routine of FIG. 12, unrepresentatively-high instantaneous engine speeds may randomly occur, and combustion detection reliability is improved by the elimination of this source of error.

Figure 13:
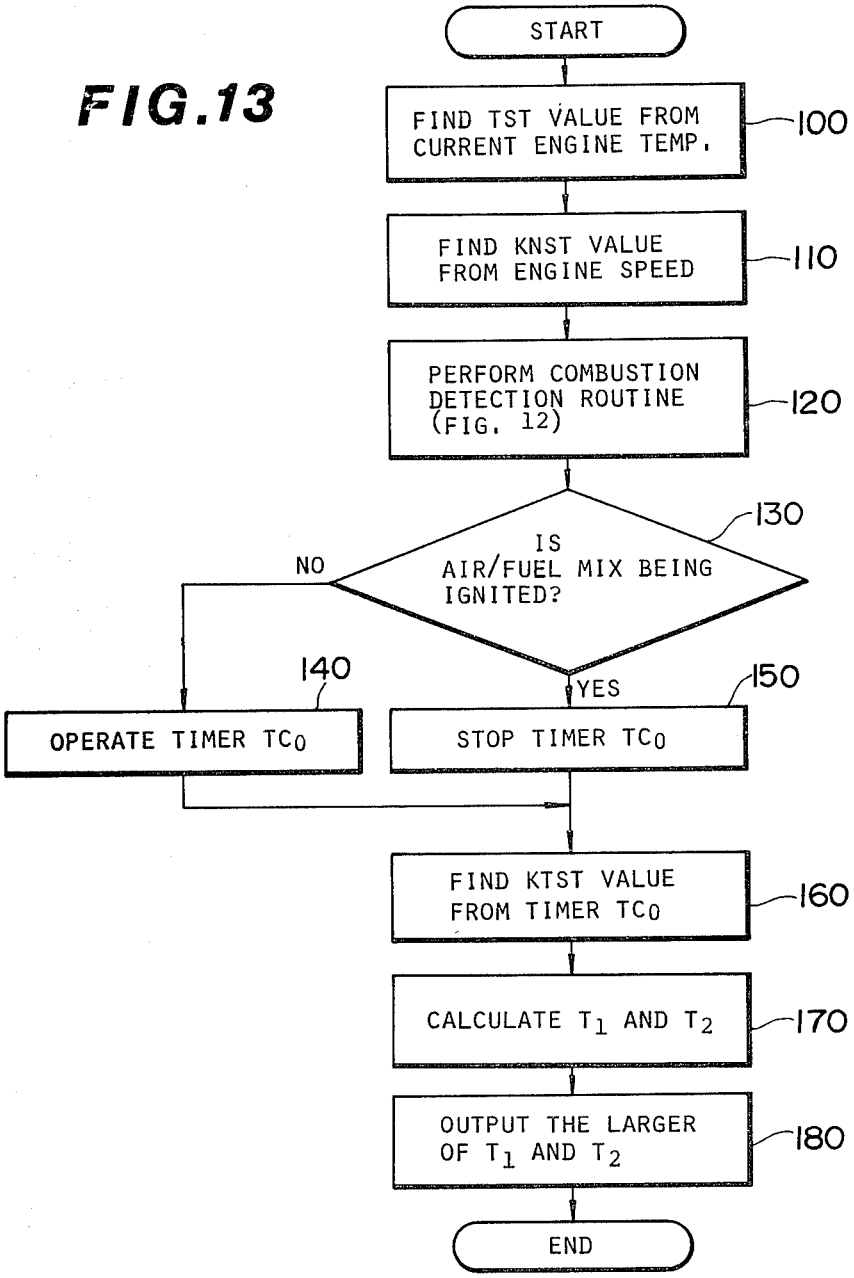
FIG. 13 is a flowchart of the method according to the present invention.

The routine of FIG. 12 is used in the overall start-up fuel supply calculation routine shown in FIG. 13. The current values of TST (FIG. 14) and KNST (FIG. 8) are derived from engine temperature and speed values respectively in consecutive program steps 100 and 110. The combustion detection routine of FIG. 12 is next performed in step 120. In step 130, the flag $F_o$ is checked to determine if fuel ignition has occurred - if so, control goes to step 150, otherwise control goes to step 140. Step 140 increments a cranking timer $TC_o$, which is held constant in step 150. In either case, control passes to step 160, wherein the current value of timer $TC_o$ is used to derive the value of KTST, either from FIG. 15 or from a modified relationship to be described later. In step 170, fuel supply values $T_1$ and $T_2$ are calculated using equatins (2) and (1) respectively. The two values are compared and the larger is outputted to the driver 33 of fuel injection valve 32 at the final step 180. It is noted that the method according to the present invkention is effected when $T_2$ is greater than $T_1$.

When a microcomputer is employed as control unit 50, the frequency of execution of the procedures shown in FIGS. 12 and 13 will provide excellent response of the resultant fuel supply value to changes in sensed engine conditions.

Figure 14:
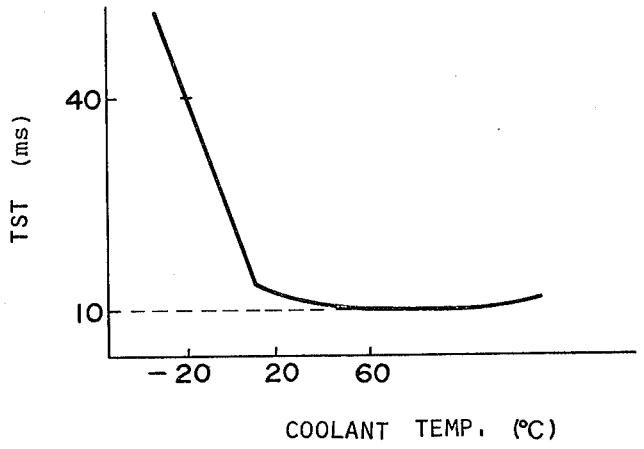
FIG. 14 is a graph of the relationship between TST and coolant temperature according to the present invention.
Figure 15:
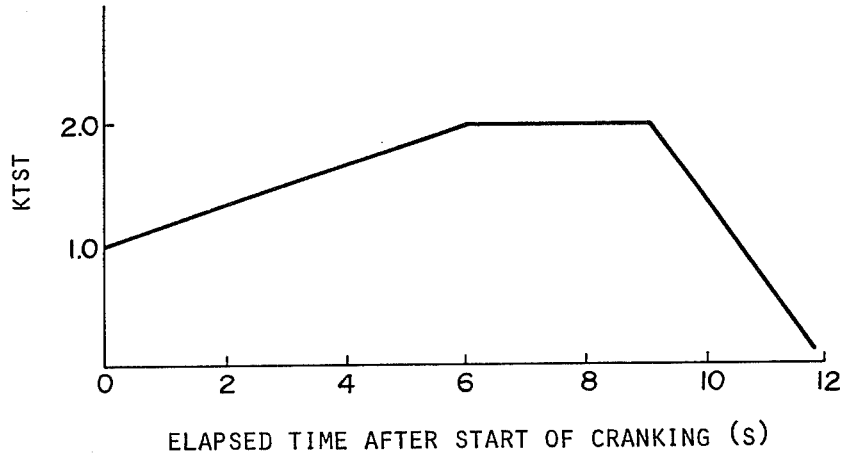
FIG. 15 is a graph of the relationship between KTST and time according to the present invention.

Additionally in the preferred embodiment, the factors TST and KTST used in the calculation of the first fuel supply value $T_2$ are modified to produce a $T_2$ value which increases with time until fuel ignition. The modified graphs thereof are shown in FIGS. 14 and 15, respectively, for comparison with the prior art values shown in FIGS. 7 and 9. At corresponding engine temperatures, the modified TST values can be seen to be about half as large as in the prior art at lower temperatures. This causes $T_2$ to have an initial value slightly lower than sufficient for combustion. In addition, the value of KTST used in the preferred embodiment increases with time for a period of time sufficient to start the engine before decreasing to zero. The result of these modifications will be a first fuel supply value $T_2$ which normally starts at a level insufficient for combustion, increases within a few seconds to a level sufficient for combustion, and then (ignoring the effect of combustion detector 52) drops to zero between 10 and 12 seconds after the start of engine cranking.

Figure 16:
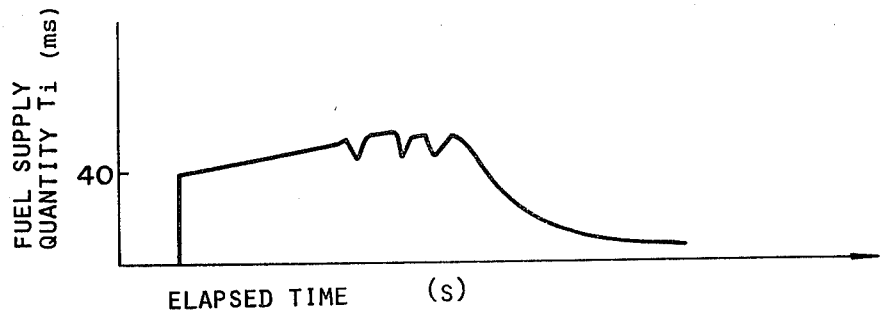
FIG. 16 is a graph of fuel supply quantity versus time in an exemplary execution of the method of the present invention.
Figure 17:
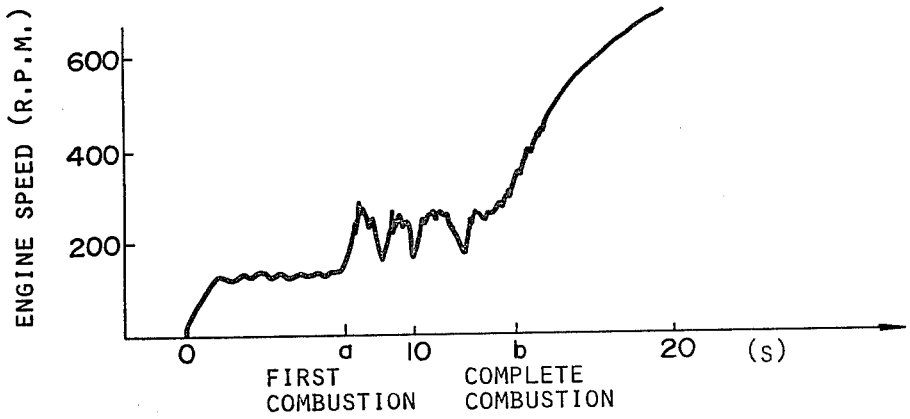
FIG. 17 is a graph of engine speed versus time corresponding to FIG. 16.

The effect of the net modification to fuel supply value $T_2$ can be best illustrated by an exemplary execution of the method of the preferred embodiment of the invention, such as is shown in FIGS. 16 and 17. At the time labeled "0" in FIG. 17, the starter motor is started. An amount of fuel corresponding to the initial value of $T_2$, for example 40 ms (the time during which the injector 32 in FIG. 1 is opened) at an engine coolant temperature of −20° C., is immediately injected, as shown by the trace of FIG. 16. After that, the amount of injected fuel increases with time, as $T_2$ increases, until first combustion occurs at time a. Hereafter, the value of KTST is derived from FIG. 15 using the time a, which is held in cranking timer $TC_o$, and thus $T_2$ does not change further in sole dependence on time. Rather, the effect of changes in the value of KNST due to changes in engine speed now produces the variation of injected fuel quantity because TST remains substantially constant between time a and time b when complete combustion occurs. Combustion continues after time a at an irregular, fluctuating level of completeness reflected in the trace of engine speed with respect to time in FIG. 17 until time b. At this time, the combustion chamber has warmed up sufficiently to achieve smooth, steady-state operation. As engine speed continues to climb towards normal idling speed, the value of $T_2$ drops finally to a level below that of $T_1$.

Figure 18:
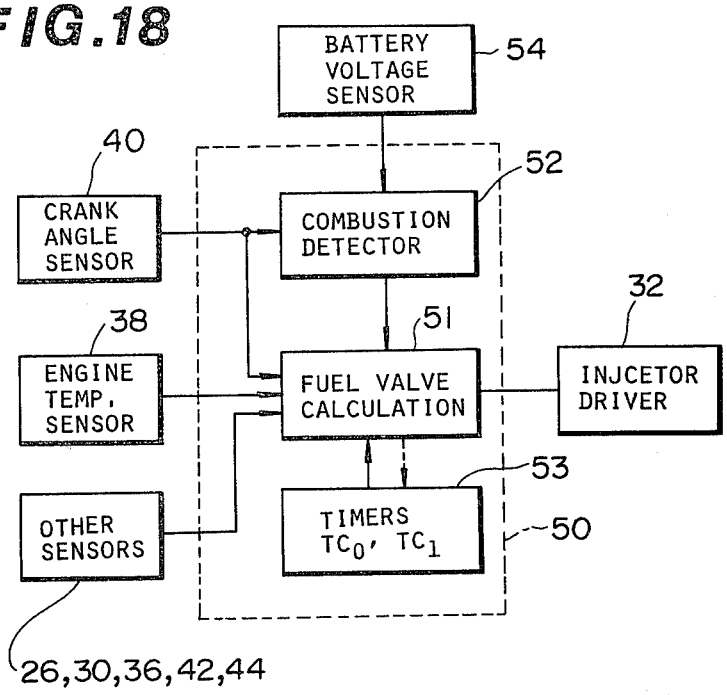
FIG. 18 is a diagram similar to FIG. 10 of a modification of the present invention.
Figure 19:
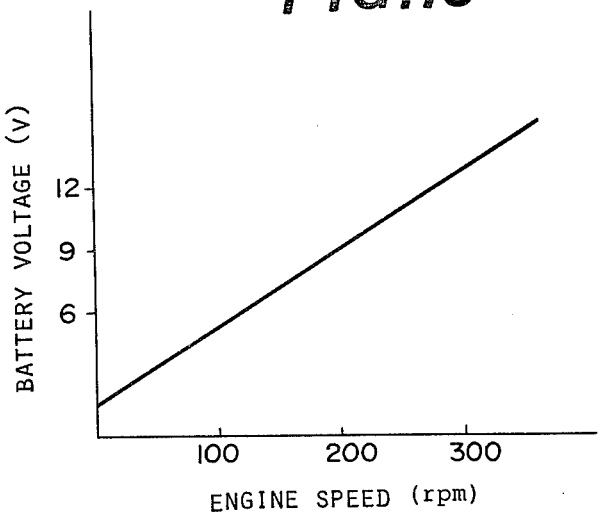
FIG. 19 is a graph of the relationship between engine speed and battery voltage.

The present invention has been described in terms of a preferred embodiment and a modification thereof, which should not be taken as limitative of the invention, but are intended for the purpose of illustration only. Many modifications to the invention can be made by those skilled in the art without departing from the spirit thereof. For example, combustion detector 52 may recognize fuel ignition through a rapid increase in battery voltage measured by a voltage sensor. In this case, a system similar to the system of FIG. 10 may be employed, as shown in FIG. 18. This system is different from that of FIG. 10 in that a battery voltage sensor 54 is provided which may be incorporated in the controller 50. At an engine temperature of −30° C. and engine speed of 120 to 130 rpm, the battery voltage detected is about 6 volts whereas the battery voltage increases up to 9 volts when combustion occurs and engine speed is 200 rpm, as shown in FIG. 19. Thus the combustion detector 52 produces a signal indicative of combustion when it receives an input from the sensor 54 greater than a predetermined value which varies according to engine speed. At an engine temperature of 25° C. and engine speed of 200 rpm where the battery voltage is 9 V, the battery voltage increases to 12 volts when combustion occurs.

Figure 20:
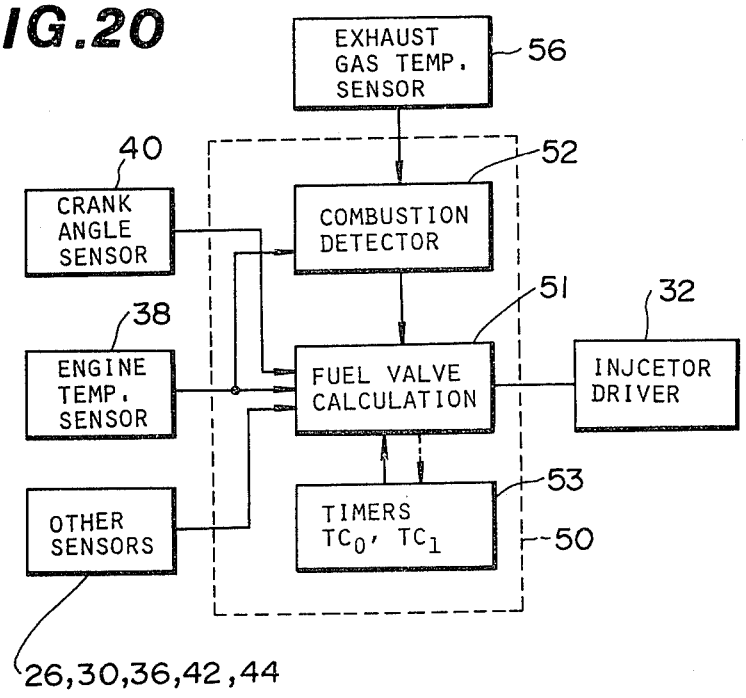
FIG. 20 is a diagram similar to FIG. 10 of a further modification of the present invention.

Alternatively, the combustion detector 52 may recognize fuel ignition through a rapid increase in the temperature of exhaust gas. The system for this is shown in FIG. 20 and is the same as that of FIG. 18 except that an exhaust gas temperature sensor 56 in the exhaust duct 34 in FIG. 1 is provided in place of the battery voltage sensor 54. When combustion does not occur the temperature of the exhaust gas will be approximately the same as the coolant temperature whereas when combustion occurs, the temperature of the exhaust gas increases by more than 20° C. The combustion detector 52 produces a signal indicative of combustion when it receives an input from the sensor 56 greater than a predetermined value which varies according to engine temperature.

Figure 21:
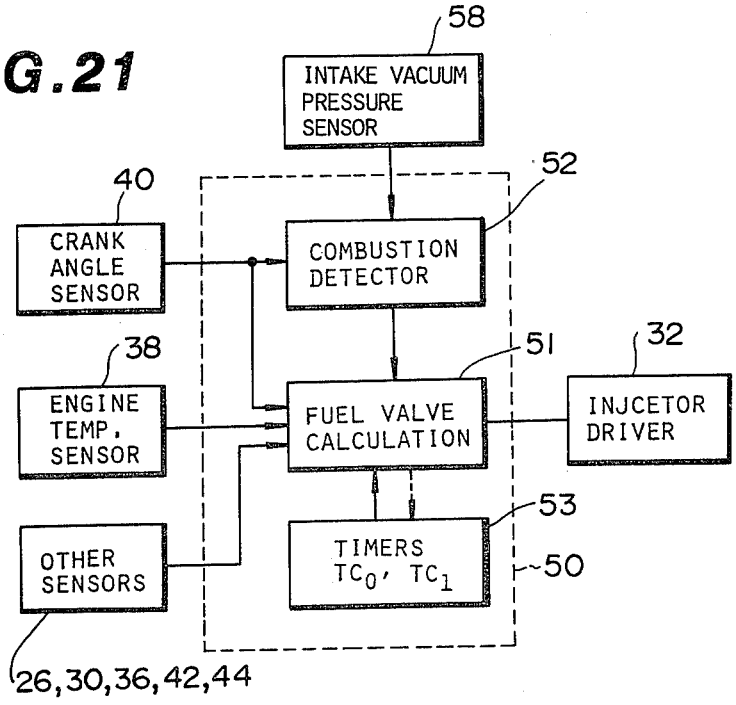
FIG. 21 is a diagram similar to FIG. 10 of another modification of the present invention.

Alternatively, the combustion detector 52 may recognize fuel ignition through a rapid increase in the intake vacuum pressure. The system for this is shown in FIG. 21 and is the same as that of FIG. 18 except that the pressure sensor 58 is provided in the air intake passageway 20 in FIG. 1 in place of battery voltage sensor 54. For example, at an engine temperature of −30° C. during cranking (120 rpm), the intake vacuum pressure is 15 mmHg whereas in response to first combustion, the intake vacuum pressure increases rapidly to 40 mmHg. The combustion detector 52 produces a signal indicative of combustion when it receives an input from the sensor 58 greater than a predetermined value which varies according to engine speed during cranking.

Figure 22:
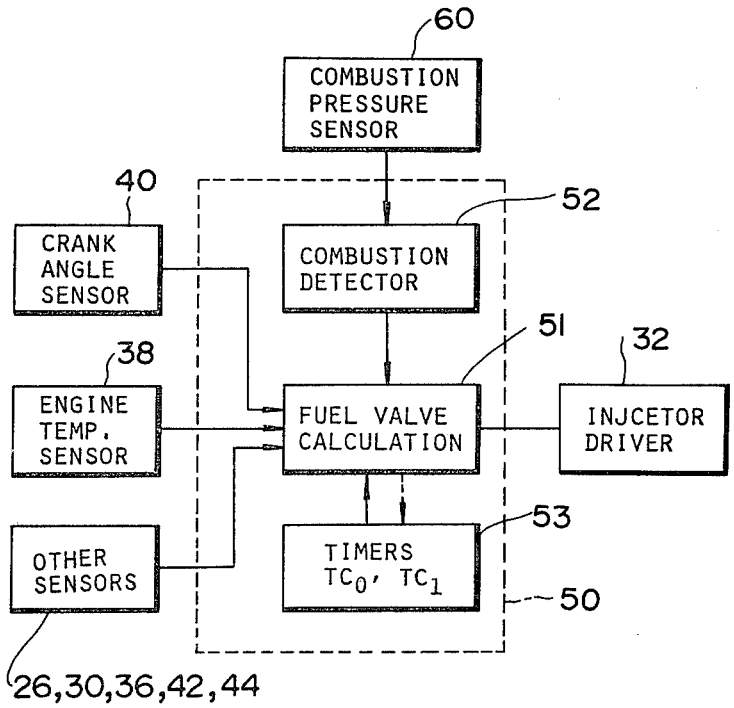
FIG. 22 is a diagram similar to FIG. 10 of still another modification of the present invention.

Alternatively, the combustion detector 52 may recognize fuel ignition through a rapid increase in the combustion chamber pressure by means of a well known combustion pressure sensor 60 incorporated in the spark plug 62 in FIG. 1. The system for this is shown in FIG. 22. For example, during cranking, the combustion chamber pressure is 7 to 8 kg/cm$^2$ whereas in response to combustion, the combustion chamber pressure increases rapidly to 12 to 15 kg/cm$^2$. The sensor 60 senses the pressure in the combustion chamber pressure and sends a signal indicative of it to the combustion detector. The combustion detector 52 produces a signal indicative of combustion when it receives an input from the sensor 60 greater than a predetermined value.

The appended claims are intended to define the scope of the present invention.

What is claimed is:

1. A method of supplying fuel to a fuel-injected internal combustion engine during start-up, comprising the steps of:

(a) sensing whether a starter motor for the engine is on or off;

(b) sensing engine temperature;

(c) sensing at least one other engine condition;

(d) determining on the basis of the sensed engine conditions whether fuel combustion is taking place within the engine;

(e) determining a first fuel supply value $T_2$ on the basis of engine temperature;

(f) changing said first value $T_2$ at a predetermined rate until fuel combustion within the engine is determined to be taking place;

(g) opening a fuel injection valve of the engine for a length of time corresponding to said first value $T_2$; and (h) after the starter motor is first sensed to be on, repeating steps (c) through (g) until the crankshaft rotates at a speed indicative of steady-state operation.

2. The method of claim 1, wherein said first value $T_2$ is at a value corresponding to a fuel supply quantity slightly less than sufficient for fuel combustion when the starter motor is first sensed to be on, and thereafter increases monotonically until fuel combustion is achieved.

3. The method of claim 1, further comprising the steps of;

(i) sensing a plurality of other engine conditions;

(j) determining a second fuel supply value $T_1$ on the basis of engine temperature, crankshaft rotation, and other engine conditions, said second value $T_1$ being initially less than said first value $T_2$;

(k) decreasing said first value $T_2$ by an amount dependent on crankshaft rotation;

(l) outputting the larger of said values $T_2$ and $T_1$ to the fuel injection valve;

(m) opening the fuel injection valve for a time corresponding to the outputting value; and (n) performing steps (i) through (m) contemporaneously with the steps (b) through (f).

4. A method according to any of claims 1 to 3, wherein in step (c), engine speed is sensed, and in step (d), fuel combustion is determined to be taking place when the sensed engine speed exceeds the engine speed resulting from cranking by the starter motor by a predetermined amount.

5. A method according to any of claims 1 to 3, wherein in step (c), battery voltage is sensed, and in step (d), fuel combustion is determined to be taking place when the sensed battery voltage exceeds that resulting from cranking by the starter motor by a predetermined amount.

6. A method according to any of claims 1 to 3, wherein in step (c), exhaust gas temperature is sensed, and in step (d), fuel combustion is determined to be taking place when the sensed exhaust gas temperature exceeds ambient temperature by a predetermined amount.

7. A method according to any of claims 1 to 3, wherein in step (c), intake vacuum pressure is sensed, and in step (d), fuel combustion is determined to be taking place when the sensed intake vacuum pressure exceeds that resulting from cranking by the starter motor by a predetermined amount.

8. A method according to any of claims 1 to 3, wherein in step (c), combustion chamber pressure is sensed, and in step (d), fuel combustion is determined to be taking place when the sensed combustion chamber pressure exceeds that resulting from cranking by the starter motor by a predetermined amount.

* * * * *